US006972657B1

(12) United States Patent
Pacala et al.

(10) Patent No.: US 6,972,657 B1
(45) Date of Patent: Dec. 6, 2005

(54) POWER CONVERTER AND PLANAR TRANSFORMER THEREFOR

(75) Inventors: Viorel Mark Pacala, Mount Laurel, NJ (US); Sunder Shahani, Jackson, NJ (US); Uditha Jayakody, Mt. Laurel, NJ (US); John Tsinetakes Jr., Hamilton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/171,606

(22) Filed: Jun. 14, 2002

(51) Int. Cl.[7] ..... H01F 5/00
(52) U.S. Cl. ..... 336/200
(58) Field of Search ..... 336/200, 206, 336/205, 180, 96; 174/113

(56) References Cited

U.S. PATENT DOCUMENTS 2,132,235 A * 10/1938 Green ..... 174/119 C
5,182,537 A * 1/1993 Thuis ..... 336/180
5,504,469 A * 4/1996 McGrane ..... 336/206
5,847,947 A * 12/1998 Pan et al. ..... 363/61
6,307,457 B1 * 10/2001 Wissink et al. ..... 336/200

FOREIGN PATENT DOCUMENTS

JP 59078508 A * 5/1984

* cited by examiner

*Primary Examiner*—Tuyen T Nguyen
(74) *Attorney, Agent, or Firm*—Duane Morris LLP

(57) ABSTRACT

A planar transformer includes a primary winding surrounding a portion of a magnetic core. The primary winding is made up of a bundle of individually insulated conductors (wires) in a bundle, and the bundle is itself separately insulated as a whole. A secondary winding of insulated conductor makes at least one turn around the portion of the core. In one embodiment, the secondary winding is a planar concentric spiral structure with an out-of-plane bridging conductor. Electrical connection tabs may be located adjacent the "ends" of the secondary winding for connection of rectifiers. Series inductors may be connected to each of the tabs and to the direct-current output port of the transformer/rectifier combination, and the conductors of the series inductors may be monolithic with the secondary winding.

10 Claims, 5 Drawing Sheets

POWER CONVERTER AND PLANAR TRANSFORMER THEREFOR

GOVERNMENTAL INTEREST

This invention was prepared under government contract N00024-99-9-5386. The United States Government has a non-exclusive, non-transferable, paid-up license in this invention.

FIELD OF THE INVENTION

This invention relates to switching power converters or supplies, and more particularly to planar transformers suited for use therewith.

BACKGROUND OF THE INVENTION

High-frequency power converters are widely used for consumer products and for industrial purposes. Such converters are often used to convert mains power to direct voltage for powering electronic equipment, or are dc-to-dc converters for converting a source of direct voltage to another direct voltage for use.

Power converters, especially for consumer uses, and for critical industrial and military uses, must be highly efficient, small in size, and very reliable. In addition, they must be inexpensive. It is generally recognized that the efficiency and size constraints of switching power converters are associated with the size, configuration and material of the magnetic components, as for example the core of a transformer or of an inductor.

In addition to the abovementioned requirements placed on the performance of a power converter by competitive pressures, it is additionally necessary, for safety reasons, to comply with the requirements of standards-setting bodies, such as Underwriters Laboratories (UL). UL standards for power converters include a shock hazard requirement, which may be interpreted to mean that the primary and secondary windings of a transformer which provide electrical isolation between the "inside" of an electrical apparatus and the "outside" must have three layers of electrical insulation. The magnetic winding is deemed to be electrically conductive.

There are many ways to achieve the triple insulation goal. In some cases, this electrical insulation or isolation requirement is met in conventional transformers by placing an insulating sheet over a magnetic core, winding a primary or secondary winding of insulated wire on the insulating sheet surrounding the magnetic core, placing an additional insulating sheet around the winding so placed, and then winding a separate turn or turns of independently insulated wire over the second sheet of insulation. Thus, each of the conductive windings is separated from the magnetic core by its own wire insulation and a sheet of insulation. The sheet of insulating material has traditionally been a stable, inexpensive and rugged material known as "fish paper," although other materials are used.

Another way to achieve the triple isolation goal is to place the individual insulated wire windings on separate bobbins of insulating material. Each bobbin is then placed on a separate portion or leg of the magnetic core, so that each winding is isolated from the magnetic core by a bobbin and the wire insulation, and the conductors are isolated from each other by at least an air space and the wire insulation of each winding.

Improved power converters are desired.

SUMMARY OF THE INVENTION

In general, a planar transformer according to an aspect of the invention includes a primary winding surrounding a portion of a magnetic core. The primary winding is made up of a bundle of individually insulated conductors (wires) in a bundle, and the bundle is itself separately insulated as a whole. A secondary winding of insulated conductor makes at least one turn around the portion of the core. In one embodiment, the secondary winding is a planar concentric spiral structure with an out-of-plane bridging conductor. Electrical connection tabs may be located adjacent the "ends" of the secondary winding for connection of rectifiers. Series inductors may be connected to each of the tabs and to the direct-current output port of the transformer/rectifier combination. In a preferred embodiment, the conductor(s) of the series inductors are monolithic with the conductor(s) of the secondary winding. In a preferred version, the primary winding is split into two portions, which straddle the secondary winding.

More particularly, a transformer according to an aspect of the invention comprises a magnetic core and an elongated primary winding defining turns around at least a portion of the magnetic core. The primary winding includes a bundle of individually insulated conductors with a layer of insulation surrounding the bundle of individually insulated conductors. A secondary winding defines at least one turn around the portion of the magnetic core, and the secondary winding includes at least one individually insulated conductor. In one version, the individually insulated conductors of the primary winding have generally circular cross-sections, and the bundle also has a generally circular cross-section. In a preferred version, the individually insulated conductor of the secondary winding has a planar spiral configuration. When the secondary winding is a planar spiral, an out-of-plane bridge conductor may be connected to that portion of the individually insulated conductor of the secondary winding which lies adjacent the center of the planar spiral, for providing access to the end of the secondary winding adjacent the interior of the spiral. In a version particularly suited for use with a power converter, connection tabs monolithic with the secondary winding are provided at locations adjacent the magnetic core. In a most preferred version, the transformer secondary winding is monolithic with at least one additional conductor which extends through magnetic core means for defining an inductor adjacent the secondary winding. The magnetic core means of the series inductor may be monolithic with the transformer core if desired. The primary winding may be split into two portions, one of which lies on a first side of the planar spiral, and the other of which lies on the other side of the planar spiral.

Yet more particularly, a transformer, according to an aspect of the invention, comprises a first generally planar magnetic core defining first and second mutually parallel broad sides and first and second apertures or windows extending parallel to the first and second broad sides. A multiturn primary winding is in the form of a plurality of individually insulated, electrically conductive wires extending generally parallel to each other to thereby form a set of wires, and the set of wires, taken as a whole, is provided with a layer or coating of electrical insulation separate from that of the individually insulated, electrically conductive wires. The individual insulation of each wire may be in the form of enamel, and the additional layer is preferably in the form of polytetrafluoroethane or polytetrafluoroethylene. The primary winding extends through the first and second apertures for, when energized, inducing magnetic flux in a portion of the magnetic core. A secondary winding of electrically insulated planar electrical conductor includes at least one planar turn defining an open center. The secondary winding includes first and second terminations exterior to the planar turn. The electrical conductor of the planar turn of the secondary winding extends through the first and second apertures and has its open center encircling the portion of the magnetic core. The secondary winding further includes first and second electrical connection portions external to the magnetic core. If the secondary winding includes a plurality of planar turns, it further comprises an out-of-plane electrically insulated, electrically conductive bridge associated with at least one turn of the plurality of planar turns, for, in response to the magnetic flux in the portion of the magnetic core, producing a secondary voltage across the first and second terminations.

In one avatar of the invention, the plurality of individually insulated, electrically conductive wires extend generally parallel to each other to thereby form a set of wires comprises a plurality of the wires twisted together. In another avatar, the plurality of individually insulated, electrically conductive wires extend generally parallel to each other to thereby form or define a set of wires braided together. The individually insulated, electrically conductive wires comprise wires individually insulated with enamel. In a preferred embodiment, the plurality of individually insulated, electrically conductive wires, as a set, is provided with a separate layer of insulation, which in a most preferred version comprises at least one of polytetraethylene and polytetraethane. The insulation on the secondary winding comprises a layer of either polytetrafluoroethylene or polytetrafluoroethane.

In one hypostasis of the invention, the secondary winding contains copper, and the secondary winding is coated with silver, which is in turn coated with one of polytetrafluoroethylene and polytetrafluoroethane.

A particularly advantageous association of the transformer is with first and second electrically conductive planar extensions of the first and second terminations. The first planar extension defines a body portion and an end portion, and the second planar extension defines a body portion and an end portion. Second and third magnetic cores surround the body portions of the first and second electrically conductive planar extensions of the first and second terminations, respectively, thereby increasing the inductance of the first and second electrically conductive planar extensions of the first and second terminations. It is desirable to include a further electrical connection connected to the first and second end portions of the first and second planar extensions of the first and second terminations, for shorting together the first and second terminations, to thereby provide a convenient connection point.

A particular implementation of the transformer is one in which (a) the secondary winding of electrically insulated planar electrical conductor, (b) the out-of-plane electrically insulated, electrically conductive bridge, if any, and (c) at least the body portions of the first and second electrically conductive planar extensions of the first and second terminations are continuous integrated conductors with continuous insulation, except at the first and second terminations exterior to the planar turn.

According to another aspect of the invention, a converter comprises a source of alternating voltage and a transformer. The transformer includes a first generally planar magnetic core defining first and second mutually parallel broad sides and first and second apertures extending parallel to the first and second broad sides. The transformer also includes a multiturn primary winding in the form of a plurality of individually insulated, electrically conductive wires extending generally parallel to each other to thereby form a set of wires. The set of wires is provided with a layer of electrical insulation separate from that of the individually insulated, electrically conductive wires. The primary winding extends through the first and second apertures for, when energized, inducing magnetic flux in a portion of the magnetic core. The transformer also includes a secondary winding of electrically insulated planar electrical conductor. The secondary winding includes at least one planar turn defining an open center. The secondary winding including first and second terminations exterior to the planar turn. The electrical conductor of the planar turn of the secondary winding extends through the first and second apertures and has its open center encircling the portion of the magnetic core. The secondary winding further includes first and second electrical connection portions external to the magnetic core, and if the secondary winding includes a plurality of planar turns, further comprises an out-of-plane electrically insulated, electrically conductive bridge associated with at least one turn of the plurality of planar turns, for, in response to the magnetic flux in the portion of the magnetic core, producing a secondary voltage across the first and second terminations.

The converter further comprises first and second unidirectional current conducting devices, each including a cathode and an anode. The first and second unidirectional current conducting devices have corresponding electrodes electrically connected together to define a reference conductor. An arrangement couples that electrode of the first unidirectional current conducting device remote from the reference conductor to the first termination exterior to the planar turn, and that electrode of the second unidirectional current conducting device to the second termination exterior to the planar turn. A first inductor is connected to the first termination exterior to the planar turn and to a common point. A second inductor is connected to the second termination exterior to the planar turn and to the common point. A storage capacitor is connected to the reference conductor and to the common point. A load may be coupled to the reference conductor and to the common point.

DESCRIPTION OF THE INVENTION

One of the ways in which the size of the power transformer portion of a power converter can be reduced is to increase the operating frequency at which the transformer operates. In general, a transformer is an inductive or magnetic device, which provides increased coupling as the frequency increases. However, the advantages of increasing frequency are offset by increases in losses in the magnetic core material as frequency increases, and also by the "skin effect." The skin effect is an increase in effective heating losses in a conductor with increasing frequency, resulting from the self-inductance of the conductor, which tends to force the current to flow only near the outer surface of the conductor, thereby tending to increase the effective resistance of the conductor, and therefore increase the $I^2R$ losses. Thus, frequency can be increased only to a certain point, which depends upon the configuration and characteristics of the transformer and its magnetic core.

Another way to decrease the size and weight of a power converter is to use a "current doubler" configuration, in which the overall size of the filter inductance is reduced by splitting the current flow through the inductance into two portions, each handled by a separate inductor. The separate inductors, each handling half-current, can be smaller than the size of a single inductor capable of handling the full current.

Figure 1A:
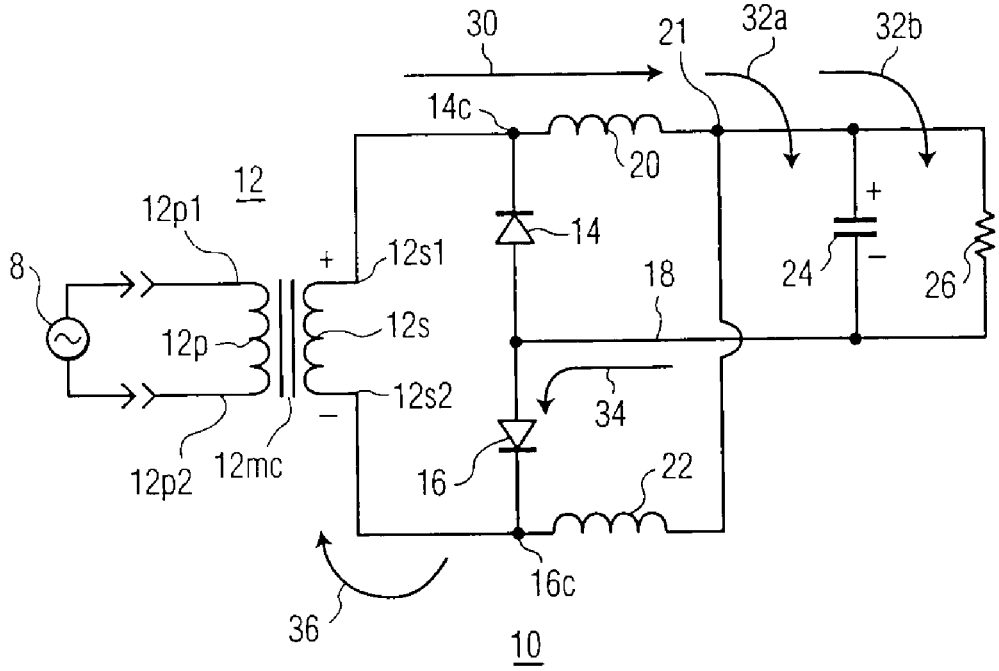
FIG. 1a PRIOR ART
FIGS. 1*a* and 1*b* are simplified schematic diagrams of a prior-art power converter 10, showing different directions of current flow, depending upon the polarity of the applied power.
Figure 1B:
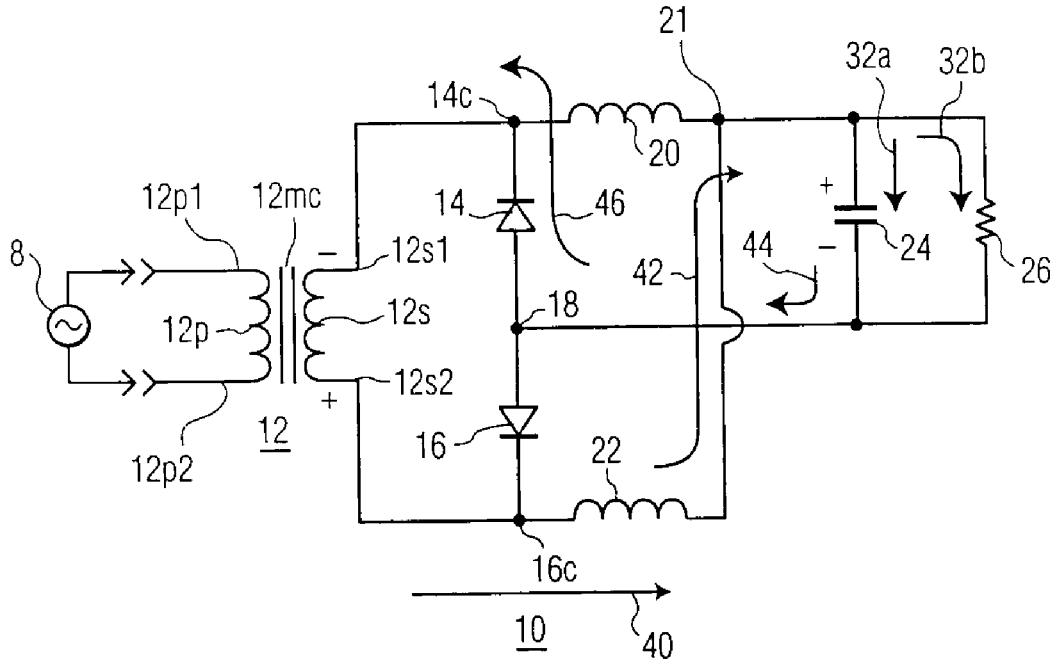
FIG. 1b PRIOR ART

FIGS. 1*a* and 1*b* are simplified schematic diagrams of a power converter 10, showing different directions of current flow, depending upon the polarity of the applied power. In FIG. 1*a*, a source 8 of alternating sine- or square-wave power is coupled to terminals 12*p*1 and 12*p*2 of the primary winding 12*p* of a transformer 12. Primary winding 12*p* is magnetically coupled to a magnetic core 12*mc*, in known fashion. A secondary winding 12*s* is also associated with magnetic core 12*mc*. Secondary winding 12*s* has a first terminal or end 12*s*1 connected at a junction or connection point 14*c* to the cathode of a unidirectional current conducting device 14 (diode), illustrated as a diode or rectifier. Secondary winding 12*s* also has a second end or terminal 12*s*2 connected at a connection point 16*c* to the cathode of a second diode 16. The anodes of diodes 14 and 16 are connected together "back-to-back" and to a reference conductor 18. A first inductor 20 has one end connected to connection point 14*c* and its other end connected to a common connection 21. Similarly, a second inductor 22 has one end connected to connection point 16*c* and its other end connected to common point 21. A filter capacitor 24 has one electrode or terminal connected to reference conductor 18 and the other terminal connected to common connection point 21. A load, illustrated as a resistor 26, is connected across capacitor 24. It should be emphasized that words having a spatial connotation, such as "across" and "between" have meanings in electrical contexts which differ from their normal usage.

In operation of the arrangement of FIG. 1*a* with the applied power poled such as to make end 12*s*1 of power transformer secondary winding 12*s* positive (+) relative to terminal 12*s*2, the conventional current flow (as contrasted with electron current flow) is as suggested by arrows 30, 32*a*, 32*b*, 34, and 36. More particularly, diode 14 tends to be reverse-biased and therefore nonconductive when end 12*s*1 of secondary winding 12*s* is positive, but the energy stored in inductors 20 and 22 may hold it ON or conductive for a short period. With diode 14 nonconductive, the applied + voltage causes current to flow through inductor 20, as suggested by current component arrow 30. The current then branches to flow through capacitor 24 and through load 26, as suggested by current component arrows 32*a* and 32*b*, respectively. The currents then combine to flow through reference conductor 18, as suggested by arrow 34, and finally the current returns to the negative (−) end 12*s*2 of transformer secondary 12 by way of forward-biased diode 16, as suggested by current component arrow 36.

With the opposite polarization of the applied voltage, the secondary winding 12*s* is poled negative (−) at its first end 12*s*1 and positive (+) at its second end 12*s*2, as indicated in FIG. 1*b*. With the indicated polarization of the secondary winding 12*s*, diode 16 is rendered nonconductive and diode 14 conductive. Conventional current may be viewed as flowing from secondary terminal 12*s*2 past back-biased diode 16, and through inductor 22, as suggested by current component arrow 40. The current continues to common point 21, as indicated by arrow 42. At point 21, the current splits into two portions 32*a* and 32*b*, as described above, and flows through capacitor 24 and load 26. The currents exiting capacitor 24 and load 26 combine to form a combined current represented by current component arrow 44, which flows through reference conductor 18 and forward-biased diode 14 back to terminal 12*s*1, as suggested by current component arrow 46. Thus, current flows continuously through at least one or the other of inductors 20 and 22, and each inductor must be only "large" enough to handle half the total current flowing through the load 26.

Figure 2A:
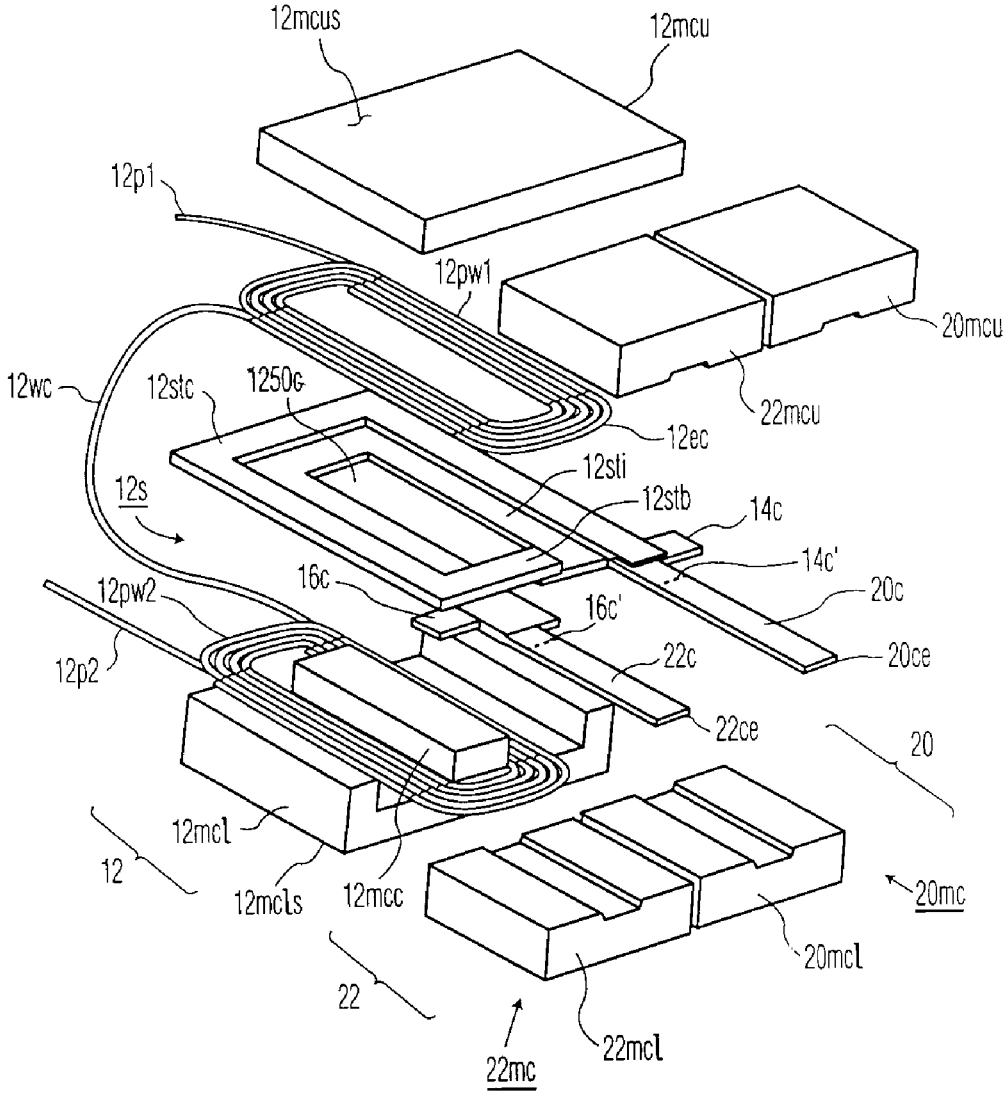
FIG. 2*a* is a simplified, exploded view of a portion of a transformer and inductor set according to an aspect of the invention, which can be used in the power converter of FIGS. 1*a* and 1*b*.

FIG. 2*a* is a simplified, exploded view of a portion of a transformer 12 and inductor set 20, 22 according to an aspect of the invention, which can be used in the power converter of FIGS. 1*a* and 1*b*. In FIG. 2*a*, transformer 12 includes a lower half of an E-type or E-shape magnetic core 12*mcl*, which defines a broad planar lower surface 12*mcls*. An upper half of the magnetic core is illustrated as 12*mcu*, and it defines a broad upper surface 12*mcus*. The two halves 12*mcl* and 12*mcu* mate to form a closed magnetic path having a central magnetic portion 12*mcc*, as known in the art.

Figure 2B:
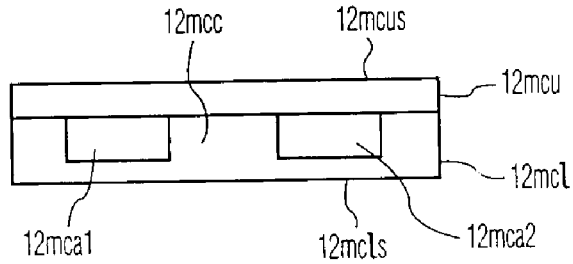
FIG. 2*b* is an elevation view of a magnetic structure of FIG. 2*a* in its assembled condition to illustrate windows or apertures.

In FIG. 2*a*, a primary winding 12*p* is illustrated as being divided into two separate, but connected, portions 12*pw*1 and 12*pw*2. The two separate portions 12*pw*1 and 12*pw*2 are serially connected by way of a continuation of the windings designated 12*wc*. Each portion 12*pw*1 and 12*pw*2 is similar, and each defines a central aperture or window dimensioned to fit over central magnetic core portion 12*mcc*. The primary windings are in the form of twisted or braided, individually insulated small wires forming a set of wires, with the set of wires separately insulated. Primary winding 12*pw*2 has its window placed over central magnetic core portion 12*mcc*. A secondary winding arrangement illustrated as 12*s* in FIG. 2*a*, also defining a window or open center 12*soc* dimensioned to accommodate magnetic core center 12*mcc*, is placed over primary winding portion 12*pw*2. The other portion 12*pw*1 of primary winding 12*p* is then placed over the secondary winding 12*s*, and the magnetic cover or lid 12*mcu* is then placed over the lower magnetic core portion 12*mc*1 to form a closed magnetic structure illustrated in FIG. 2*b*, which defines first and second through apertures or windows 12*mca*1 and 12*mca*2, extending parallel with planar upper surface 12*mcus* and lower surface 12*mcls*. With the described structure of transformer 12 of FIG. 2*a*, the primary and secondary windings extend through the apertures 12*mca*1 and 12*mca*2, with the free ends 12*p*1 and 12*p*2 of the primary winding externally available, and the ends 14*c* or 14*c*', 16*c* or 16*c*' of the secondary windings also externally available.

Figure 3A:
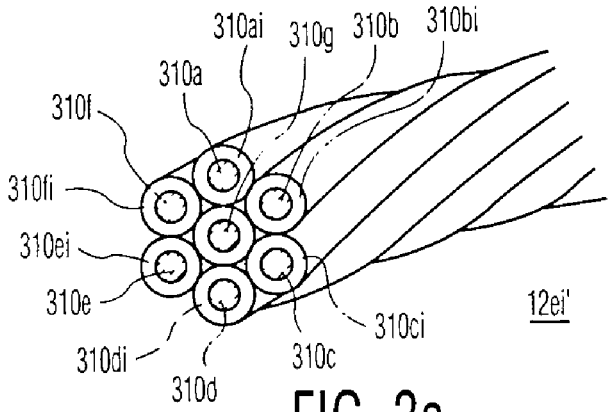
FIG. 3*a* is a perspective or isometric view of a portion of the multiconductor primary winding of FIG. 1*a* or FIG. 2*a*.
Figure 3B:
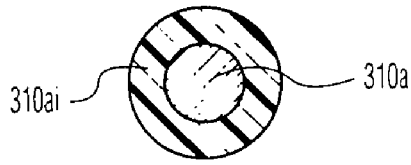
FIG. 3*b* is a cross-section of one individual conductor of the primary winding of FIG. 3*a* with its individual insulation.

FIG. 3*a* is a perspective or isometric view of a portion of primary winding 12*p* of FIG. 1*a* or 12*pw*1 of FIG. 2*a*. In FIG. 3*a*, one "strand" 12*ec*' of primary winding is illustrated as being a plurality of individually insulated electrically conductive wires. The electrically conductive wires illustrated in FIG. 3*a* are designated 310*a*, 310*b*, 310*c*, 310*d*, 310*e*, 310*f*, and 310*g*, and the insulation surrounding each individual wire is designated 310*ai*, 310*bi*, 310*ci*, 310*di*, 310*ei*, 310*fi*, and 310*gi*, respectively. FIG. 3*b* illustrates a cross-section of a single wire, namely wire 310*a*, of FIG. 3*a*, with its surrounding insulation 310*ai*. In one embodiment of the invention, the insulation 310*ai* is enamel. Such sets of twisted or braided thin wire, without the individual insulation layers, are sometimes known as "litz wire."

Figure 3C:
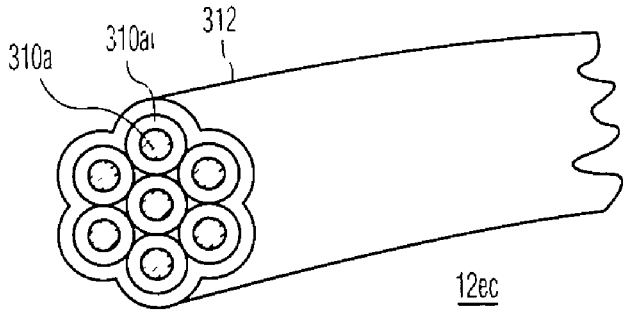
FIG. 3*c* is a perspective or isometric view of the multiconductor winding of FIG. 3*a* further coated with an independent layer of additional insulation.
Figure 3D:
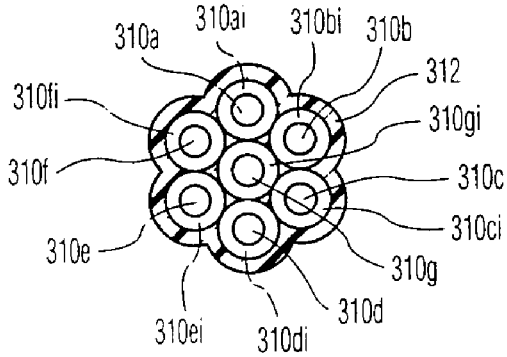
FIG. 3*d* is a cross-section of the primary winding of FIG. 3*c;*

In addition to the individual insulation of each wire strand as described in conjunction with FIGS. 3*a* and 3*b*, the entire set of wires 12*ec*' is provided with at least an exterior layer of additional insulation, illustrated as 312 in FIG. 3*c*, to thereby make or define primary winding 12*ec*. FIG. 3*d* is a cross-section of the set of wires 12*ec* of FIG. 3*c*, showing each wire, its individual insulation, and the surrounding additional layer of insulation. In a particularly advantageous embodiment of the invention, the additional layer of insulation is polytetrafluoroethylene or polytetrafluoroethane (TEFLON) because of (a) its ability to be formed in thin sheets, (b) its high temperature capability without degradation, and (c) its low losses at high frequencies.

Figure 4A:
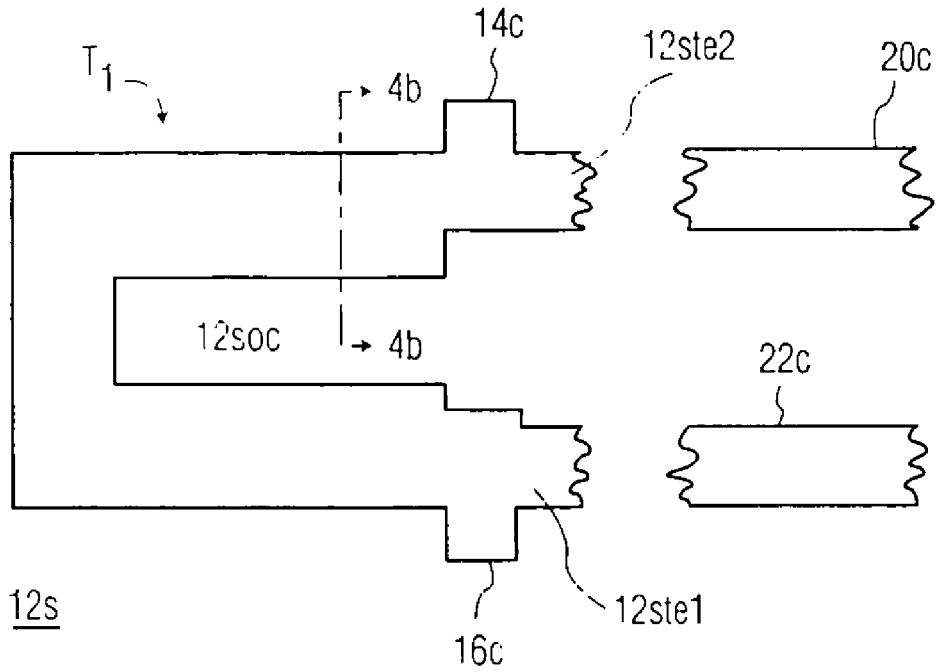
FIG. 4*a* is a plan view of a planar single-turn secondary winding which may be used in the transformer of FIG. 2*a*.
Figure 4B:
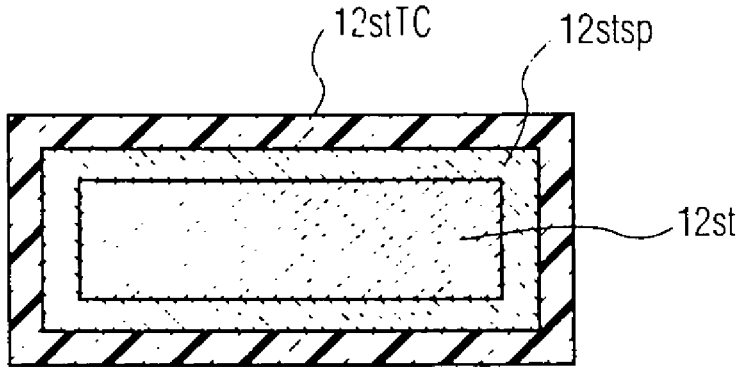
FIG. 4*b* is a cross-section of the single-turn secondary winding, showing the layer of insulation thereon.

FIG. 4*a* is a simplified plan view of a planar single-turn ($T^{1)}$ secondary winding 12*s* which may be used in the transformer 12 of FIG. 2*a*. In FIG. 4*a*, the single turn is illustrated as being a relatively wide "U" shaped conductor defining an open center portion 12*soc*, and also defining first and second electrical connection tabs 14*c* and 16*c*, for connection of the unidirectional current conducting devices of FIGS. 1*a* and 1*b*. Also illustrated in FIG. 4*a* are first and second end, continuation, or additional connection regions 12*ste*1 and 12*ste*2, adjacent tabs 16*c* and 14*c*, respectively. In addition, the arrangement of FIG. 4*a* shows additional conductors designated 20*c* and 22*c*, which may be continuations of the turn of conductor by integral or monolithic connection at connection regions 12*ste*1 and 12*ste*2. It will be apparent from FIG. 4*a* that the single-turn secondary winding is planar, so takes up very little vertical space within the window or apertures of the magnetic core. FIG. 4*b* is a cross-section of the secondary conductor of FIG. 4*a* looking in the direction of section lines 4*b*–4*b*. In FIG. 4*b*, the conductor is designated as 12*st*, and an outer layer or coating of polytetrafluoroethylene or polytetrafluoroethane (TEFLON) is designated 12*sttc*. It has been found that, when conductor 12*st* of FIG. 4*b* contains copper, as is ordinarily the case, the copper tends to oxidize during handling and fabrication, and the TEFLON does not adhere well. The adhesion is improved by a plating 12*stsp* of a material such as silver, which does not oxidize as readily.

The secondary transformer winding 12*s* of FIG. 2*a* is not a single-turn winding such as described in conjunction with FIG. 4*a*, but is instead a multiturn winding, in this particular case having two turns, namely an inner turn 12*sti* and an outer turn 12*sto*. The two-turn winding of FIG. 2*a* defines a window or open center 12*soc* dimensioned to fit over central portion 12*mcc* of the magnetic core 12*mc*. It will be clear that a planar magnetic winding including a plurality of turns (a spiral) can have one end of the winding lying in the plane of the spiral and external to the winding, but the other end of the winding must be within the spiral. The only way to get access to the inner end of the winding while maintaining the desired inductance is by way of an out-of-plane conductor. The out-of-plane conductor may simply connect to the inner end of the spiral, and couple it to the exterior of the winding. As an alternative, some portion of the winding must be provided with an out-of-plane conductive portion.

Figure 5A:
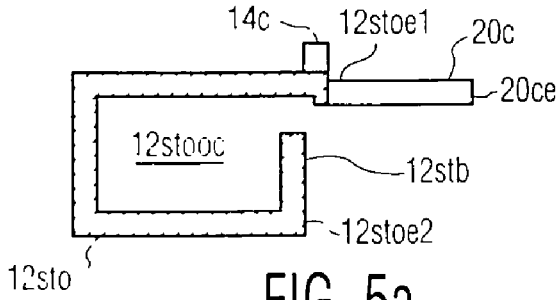
FIG. 5*a* is a plan view of a planar outer turn or winding of a multiturn secondary winding which may be used in the transformer of FIG. 2*a*.
Figure 5B:
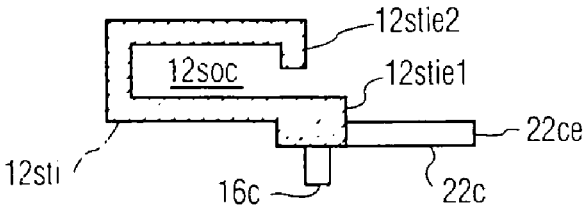
FIG. 5*b* is a plan view of a planar inner turn which may be nested within the outer turn of FIG. 5*a*.
Figure 5C:
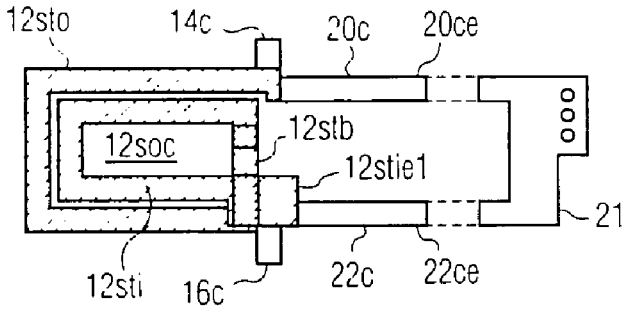
FIG. 5*c* illustrates the turns of FIGS. 5*a* and 5*b* nested together and interconnected.

The two-turn winding 12*s* of FIG. 2*a* can be made as illustrated in the plan views of FIGS. 5*a*, 5*b*, and 5*c*. In FIG. 5*a*, the exterior or outer winding 12*sto* is in the form of a portion of a spiral, and includes one connection tab 14*c*. Adjacent tab 14*c*, the structure of the outer turn of FIG. 5*a* includes an end 12*stoe*1. While this is the "end" of the transformer secondary winding, it is not the end of the conductor, because conductor 20*c* is monolithically connected thereto at "end" 12*stoe*1 to form a continuous conductor, which in turn defines a further "end" 20*ce*. The other or second "end" of the outer turn of FIG. 5*a* may be viewed as being at the corner designated 12*stoe*2. An additional "bridge" conductor 12*stb* is monolithically connected to "end" 12*stoe*2.

The two-turn winding of FIG. 2*a* also includes an inner winding 12*sti*, illustrated in FIG. 5*b*. As illustrated, inner turn defines central opening 12*soc*. The inner turn of FIG. 5*b* also includes or is associated with an end or connection tab 16*c*. The end of the inner winding or turn of secondary winding 12*sti* may be viewed as being at the location designated 12*stie*1 of FIG. 5*b*. However, just as in the case of the outer turn discussed in conjunction with FIG. 5*a*, an additional conductor portion 22*c* is monolithically or at least integrally connected to end 12*stie*2, and extends therefrom to a further "end" point 22*ce*.

Figure 5D:
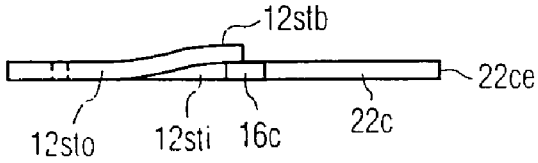
FIG. 5*d* is a side elevation view of the structure of FIG. 5*c*, showing out-of-plane conductor.

The outer or exterior dimensions of inner turn 12*st*1 of FIG. 5*b* are, for the most part, no greater than the interior dimensions of the window or open center 12*stooc* of outer winding 12*sto* of FIG. 5*a*, so that the inner winding 12*sti* may lie coplanar with and nested within outer winding 12*sto*. FIG. 5*c* illustrates the result of the nesting of the two windings of FIGS. 5*a* and 5*b*. As illustrated in FIG. 5*c*, the inner turn 12*sti* is nested within the window 12*stooc* of the outer turn 12*sto*. In the nested position, end portion 12*stie*2 of the inner turn 12*sti* is overlain by the bridge portion 12*stb* of the outer turn 12*sto*. This overlying results in an out-of-plane condition which allows both ends of the spiral secondary winding 12*s* of FIG. 2*a* to be available or accessible. More particularly, the planar structure with the out-of-plane conductor is illustrated in the side elevation view of FIG. 5*d*. In FIG. 5*d*, elements corresponding to those of FIGS. 5*a*, 5*b*, and 5*c* are designated with the same reference numerals. As can be seen, the bridge 12*stb* rises above the plane of the exterior or outer turn 12*sto*, so that the bridge portion 12*stb* can lie above that portion of inner turn 12*sti* which it traverses to make contact with the inside-the-spiral end 12*stie*2 of the inner turn 12*sti*. The rise of the bridge portion of outer turn 12*sto* exposes a bit of the inner turn 12*sti*. In addition, the very fact that the bridge 12*stb* overlies the end 12*stie*2 results in an out-of-plane condition.

Figure 5E:
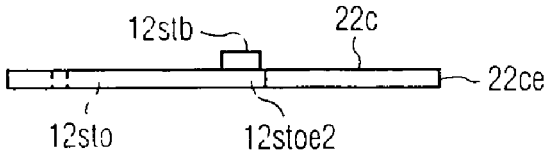
FIG. 5*e* is a side elevation view similar to that of FIG. 5*d*, but showing a separate bridge element.

Since an out-of-plane condition must exist in any case, another way to fabricate the two-turn structure, or by extension a structure having any number of concentric or spiral turns, is to use a separate bridge element to make connection from the inside of the spiral to the outside. FIG. 5*e* illustrates the use of a separate bridge element overlying both the inside-the-spiral end 12*stie*2 of the inner turn 12*sti* and the "end" 12*stoe*2 of the outer turn 12*sto*. The connection can be completed by soldering or welding at two locations.

In one embodiment of the invention, the secondary windings were coated or insulated with "Edathon" fluoropolymer coating, available from PCM Plastics Consulting and Marketing Co. of 1431 Ferry Avenue, Camden, N.J. 08104.

Thus, a transformer (12) according to an aspect of the invention comprises a magnetic core (12*mc*) and an elongated primary winding (12*p*) defining turns around at least a portion (12*mcc*) of the magnetic core (12*mc*). The primary winding (12*p*) includes a bundle of individually insulated conductors (310*a*, 310*ai*) with a layer of insulation (312) surrounding the bundle of individually insulated conductors. A secondary winding (12*s*) defines at least one turn around the portion (12*mcc*) of the magnetic core (12*mc*), and the secondary winding (12*s*) includes at least one individually insulated conductor. In one version, the individually insulated conductors of the primary winding (12*p*) have generally circular cross-sections, and the bundle also has a generally circular cross-section. In a preferred version, the individually insulated conductor of the secondary winding (12*s*) has a planar spiral configuration. When the secondary winding (12*s*) is a planar spiral, an out-of-plane bridge conductor (12*stb*) may be connected to that portion of the individually insulated conductor of the secondary winding (12*s*) which lies adjacent the center of the planar spiral, for providing access to the end of the secondary winding (12*s*) adjacent the interior of the spiral. In a version particularly suited for use with a power converter, connection tabs (14*c*, 16*c*) monolithic with the secondary winding (12*s*) are provided at locations adjacent the magnetic core (12*mc*). In a most preferred version, the transformer (12) secondary winding (12*s*) is monolithic with at least one additional conductor (20*c*, 22*c*) which extends through magnetic core (20*mcl*, 20*mcr*) means for defining an inductor adjacent the secondary winding (12*s*). The magnetic core means (20*mc*1, 20*mcr*) of the series inductor may be monolithic with the transformer (12) core (12*mc*) if desired. The primary winding (12*p*) may be split into two portions, one of which lies on a first side of the planar spiral, and the other of which lies on the other side of the planar spiral.

Further, a transformer (12) according to an aspect of the invention comprises a first generally planar magnetic core (12*mc*) defining first (12*mcus*) and second (12*mcls*) mutually parallel broad sides and first (12*mca*1) and second (12*mca*2) apertures or windows extending parallel to the first (12*mcus*) and second (12*mcls*) broad sides. A multiturn primary winding (12*p*, 12*ec*) is in the form of a plurality of individually insulated, electrically conductive wires (310*a*, 310*ai*; 310*b*, 310*bi*; . . . ) extending generally parallel to each other to thereby form a set (12*ec*') of wires, and the set (12*ec*') of wires, taken as a whole, is provided with a layer or coating (312) of electrical insulation separate from that of the individually insulated, electrically conductive wires (310*a*, 310*ai*; 310*b*, 310*bi*; . . . ). The individual insulation of each wire may be in the form of enamel, and the additional layer is preferably in the form of polytetrafluoroethane or polytetrafluoroethylene. The primary winding (12*p*) extends through the first (12*mca*1) and second (12*mca*2) apertures for, when energized, inducing magnetic flux in a portion (12*mcc*) of the magnetic core (12*mc*). A secondary winding (12*s*) of electrically insulated (12*sttc*) planar electrical conductor (12*st*), includes at least one planar turn ($T_1$) defining an open center (12*soc*). The secondary winding (12*s*) includes first (14*c*, 14*c*', 12*ste*1) and second (16*c*, 16*c*', 12*ste*2) terminations exterior to the planar turn ($T_1$). The electrical conductor (12*st*) of the planar turn ($T_1$) of the secondary winding (12*s*) extends through the first (12*mca*1) and second (12*mca*2) apertures and has its open center (12*soc*) encircling the portion (12*mcc*) of the magnetic core (12*mc*). The secondary winding (12*s*) further includes first (14*c*, 14*c*") and second (16*c*, 16*c*') electrical connection portions external to the magnetic core (12*mc*). If the secondary winding (12*s*) includes a plurality of planar turns, it further comprises an out-of-plane electrically insulated, electrically conductive bridge associated with at least one turn of the plurality of planar turns, for, in response to the magnetic flux in the portion (12*mcc*) of the magnetic core (12*mc*), producing a secondary voltage across the first (14*c*, 14*c*', 12*ste*1) and second (16*c*, 16*c*', 12*ste*2) terminations.

In one avatar of the invention, the plurality of individually insulated, electrically conductive wires extending generally parallel to each other to thereby form a set of wires comprises a plurality of the wires twisted together. In another avatar, the plurality of individually insulated, electrically conductive wires extending generally parallel to each other to thereby form a set of wires comprises a plurality of the wires braided together. The individually insulated, electrically conductive wires (310*a*, 310*ai*; 310*b*, 310*bi*; . . . ) comprise wires individually insulated with enamel. In a preferred embodiment, the plurality of individually insulated, electrically conductive wires, as a set, is provided with a separate layer of insulation, which in a most preferred version comprises at least one of polytetraethylene and polytetraethane. The insulation on the secondary winding comprises a layer of either polytetrafluoroethylene or polytetrafluoroethane.

In one hypostasis of the invention, the secondary winding contains copper, and the secondary winding is coated with silver, which is in turn coated with one of polytetrafluoroethylene and polytetrafluoroethane.

A particularly advantageous association of the transformer is with first (20*c*) and second (22*c*) electrically conductive planar extensions of the first (14*c*, 14*c*', 12*ste*1) and second (16*c*, 16*c*', 12*ste*2) terminations. The first planar extension (20*c*) defines a body portion (20*cb*) and an end portion (20*ce*), and the second planar extension (22*c*) defines a body portion (22*cb*) and an end portion (22*ce*). Second (20*mc*) and third (22*mc*) magnetic cores surround the body portions (20*cb*; 22*cb*) of the first and second electrically conductive planar extensions (20*c*; 22*c*) of the first (14*c*, 14*c*', 12*ste*1) and second (16*c*, 16*c*', 12*ste*2) terminations, respectively, thereby increasing the inductance of the first (20*c*) and second (22*c*) electrically conductive planar extensions of the first (14*c*, 14*c*', 12*ste*1) and second (16*c*, 16*c*', 12*ste*2) terminations. It is desirable to include a further electrical connection (21) connected to the first (20*ce*) and second (22*ce*) end portions of the first (20*c*) and second (22*c*) planar extensions of the first (14*c*, 14*c*', 12*ste*1) and second (16*c*, 16*c*', 12*ste*2) terminations, for shorting together the first (14*c*, 14*c*', 12*ste*1) and second (16*c*, 16*c*', 12*ste*2) terminations, to thereby provide a convenient connection point.

A particular implementation of the transformer is one in which (a) the secondary winding (12*s*) of electrically insulated (12*sttc*) planar electrical conductor (12*st*), (b) the out-of-plane electrically insulated, electrically conductive bridge, if any, and (c) at least the body portions of the first (20*c*) and second (22*c*) electrically conductive planar extensions of the first (14*c*, 14*c*', 12*ste*1) and second (16*c*, 16*c*', 12*ste*2) terminations are continuous integrated conductors with continuous insulation, except at the first (14*c*, 14*c*', 12*ste*1) and second (16*c*, 16*c*', 12*ste*2) terminations exterior to the planar turn ($T_1$).

According to another aspect of the invention, a converter (10) comprises a source (8) of alternating voltage and a transformer (12). The transformer includes a first generally planar magnetic core (12*mc*) defining first (12*mcus*) and second (12*mcls*) mutually parallel broad sides and first (12*mca*1) and second (12*mca*2) apertures extending parallel to the first (12*mcus*) and second (12*mcls*) broad sides. The transformer (12) also includes a multiturn primary winding (12*p*, 12*ec*) in the form of a plurality of individually insulated, electrically conductive wires (310*a*, 310*ai*; 310*b*, 310*bi*; . . . ) extending generally parallel to each other to thereby form a set (12*ec*') of wires. The set (12*ec*') of wires is provided with a layer (312) of electrical insulation separate from that of the individually insulated, electrically conductive wires (310*a*, 310*ai*; 310*b*, 31*bi*; . . . ). The primary winding (12*p*) extends through the first (12*mca*1) and second (12*mca*2) apertures for, when energized, inducing magnetic flux in a portion (12*mcc*) of the magnetic core (12*mc*). The transformer (12) also includes a secondary winding (12*s*) of electrically insulated (12*sttc*) planar electrical conductor (12*st*). The secondary winding (12*s*) includes at least one planar turn ($T_1$) defining an open center (12*soc*). The secondary winding (12*s*) including first (14*c*, 14*c*', 12*ste*1) and second (16*c*, 16*c*', 12*ste*2) terminations exterior to the planar turn ($T_1$). The electrical conductor (12*st*) of the planar turn ($T_1$) of the secondary winding (12*s*) extends through the first (12*mca*1) and second (12*mca*2) apertures and has its open center (12*soc*) encircling the portion (12*mcc*) of the magnetic core (12*mc*). The secondary winding (12*s*) further includes first (14*c*, 14*c*') and second (16*c*, 16*c*') electrical connection portions external to the magnetic core (12*mc*), and if the secondary winding (12*s*) includes a plurality of planar turns, further comprises an out-of-plane electrically insulated, electrically conductive bridge associated with at least one turn of the plurality of planar turns, for, in response to the magnetic flux in the portion (12*mcc*) of the magnetic core (12*mc*), producing a secondary voltage across the first (14*c*, 14*c*', 12*ste*1) and second (16*c*, 16*c*', 12*ste*2) terminations.

The converter (10) further comprises first (14) and second (16) unidirectional current conducting devices (diodes or rectifiers), each including a cathode and an anode. The first (14) and second (16) unidirectional current conducting devices have corresponding electrodes (anodes in FIGS. 1*a* and 1*b*) electrically connected together to define a reference conductor (18). An arrangement (conductors) couples that electrode of the first (14) unidirectional current conducting device (cathode in FIGS. 1*a* and 1*b*) remote from the reference conductor (18) to the first (14*c*, 14*c*', 12*ste*1) termination exterior to the planar turn, and that electrode of the second (16) unidirectional current conducting device to the second (16*c*, 16*c*', 12*ste*2) termination exterior to the planar turn ($T_1$). A first inductor (20) is connected to the first (14*c*, 14*c*', 12*ste*1) termination exterior to the planar turn and to a common point (21). A second inductor (22) is connected to the second (16*c*, 16*c*', 12*ste*2) termination exterior to the planar turn ($T_1$) and to the common point (21). A storage capacitor (24) is connected to the reference conductor (18) and to the common point (21). A load may be coupled to the reference conductor (18) and to the common point (21).

What is claimed is:

1. A transformer, comprising:

a magnetic core:

an elongated primary winding defining turns around at least a portion of said magnetic core, said primary winding including a bundle of individually insulated conductors with an additional layer of continuous, solid, non-wound insulation surrounding said bundle of individually insulated conductors;

a secondary winding defining at least one turn around said portion of said magnetic core, said secondary winding including at least one individually insulated conductor.

2. A transformer according to claim 1, wherein said individually insulated conductors of said primary winding have generally circular cross-sections, and said bundle also has a generally circular cross-section.

3. A transformer according to claim 1, wherein said individually insulated conductor of said secondary winding has a planar spiral configuration.

4. A transformer according to claim 3, further comprising an out-of-plane bridge conductor connected to that portion of said individually insulated conductor of said secondary winding which lies adjacent the center of said planar spiral.

5. A transformer according to claim 1, further comprising connection tabs monolithic with said secondary winding, said connection tabs being adjacent said magnetic core.

6. A transformer according to claim 1, further comprising at least one additional conductor monolithic with said secondary winding and extending through magnetic core means for defining an inductor adjacent said secondary winding.

7. A transformer according to claim 3, wherein said primary winding is split into two portions, one of which lies on a first side of said planar spiral, and the other of which lies on the other side of said planar spiral.

8. A transformer comprising:

a first generally planar magnetic core defining first and second mutually parallel broad sides and first and second apertures extending parallel to said first and second broad sides;

a multiturn primary winding in the form of a plurality of individually insulated, electrically conductive wires extending generally parallel to each other to thereby form a set of wires, said set of wires being provided with a layer of electrical insulation separate from that of said individually insulated, electrically conductive wires, said primary winding extending through said first and second apertures for, when energized, inducing magnetic flux in a portion of said magnetic core;

a secondary winding of electrically insulated planar electrical conductor, said secondary winding including at least one planar turn defining an open center, said secondary winding including first and second terminations exterior to said planar turn, said electrical conductor of said planar turn of said secondary winding extending through said first and second apertures and having said open center encircling said portion of said magnetic core, and if said secondary winding includes a plurality of planar turns, further comprising an out-of-plane electrically insulated, electrically conductive bridge associated with at least one turn of said plurality of planar turns, for, in response to said magnetic flux in said portion of said magnetic core, producing a secondary voltage across said first and second terminations;

first and second electrically conductive planar extensions of said first and second terminations, said first planar extension defining a body portion and an end portion, and said second planar extension defining a body portion and a end portion; and second and third magnetic cores surrounding said body portions of said first and second electrically conductive planar extensions of said first and second terminations, respectively, thereby increasing the inductance of said first and second electrically conductive planar extensions of said first and second terminations.

9. A transformer according to claim 8, further comprising:

a further electrical connection connected to said first and second end portions of said first and second planar extensions of said first and second terminations, for shorting together said first and second terminations.

10. A transformer according to claim 9, wherein (a) said secondary winding of electrically insulated planar electrical conductor, (b) said out-of-plane electrically insulated, electrically conductive bridge, if any, and (c) at least said body portions of said first and second electrically conductive planar extensions of said first and second terminations are continuous integrated conductors with continuous insulation, except at said first and second terminations exterior to said planar turn.

* * * * *